US009058946B2

(12) United States Patent
Villain

(10) Patent No.: US 9,058,946 B2
(45) Date of Patent: Jun. 16, 2015

(54) ELECTRICAL SWITCH ARRANGEMENT AND DEVICE FOR CONTROLLING AN APPARATUS COMPRISING SUCH AN ARRANGEMENT

(71) Applicant: C&K Components S.A.S., Dole (FR)

(72) Inventor: Jean-Christophe Villain, Dole (FR)

(73) Assignee: C&K COMPONENTS S.A.S., Dole (FR)

( * ) Notice: Subject to any disclaimer, the term of this patent is extended or adjusted under 35 U.S.C. 154(b) by 0 days.

(21) Appl. No.: 14/134,098

(22) Filed: Dec. 19, 2013

(65) Prior Publication Data

US 2014/0167890 A1 Jun. 19, 2014

(30) Foreign Application Priority Data

Dec. 19, 2012 (FR) ..... 12 62312

(51) Int. Cl.

| | |
|---|---|
| ***H01H 9/00*** | (2006.01) |
| ***H01H 36/00*** | (2006.01) |
| ***H01H 9/24*** | (2006.01) |
| *H01H 13/00* | (2006.01) |

(52) U.S. Cl.

CPC ..... *H01H 36/00* (2013.01); *H01H 9/24* (2013.01); *H01H 13/00* (2013.01)

(58) Field of Classification Search

USPC ..... 335/179

See application file for complete search history.

(56) References Cited

U.S. PATENT DOCUMENTS

| | | | | | |
|---|---|---|---|---|---|
| 3,988,710 | A | * | 10/1976 | Sidor et al. | 338/32 R |
| 4,293,837 | A | * | 10/1981 | Jaffe et al. | 338/32 H |
| 4,871,992 | A | * | 10/1989 | Petersen | 340/407.1 |
| 4,977,298 | A | * | 12/1990 | Fujiyama | 200/5 A |
| 5,121,091 | A | * | 6/1992 | Fujiyama | 335/1 |
| 5,172,092 | A | * | 12/1992 | Nguyen et al. | 340/7.58 |
| 5,327,120 | A | * | 7/1994 | McKee et al. | 340/7.6 |
| 5,666,096 | A | * | 9/1997 | Van Zeeland | 335/4 |
| 5,825,983 | A | * | 10/1998 | Park et al. | 700/264 |
| 5,867,082 | A | * | 2/1999 | Van Zeeland | 335/205 |
| 6,636,197 | B1 | * | 10/2003 | Goldenberg et al. | 345/156 |
| 6,642,824 | B2 | * | 11/2003 | Oomkes | 335/207 |
| 6,734,776 | B2 | * | 5/2004 | Belanger et al. | 336/200 |
| 6,734,785 | B2 | * | 5/2004 | Petersen | 340/407.1 |
| 6,752,637 | B2 | * | 6/2004 | Belanger et al. | 439/74 |
| 6,816,049 | B2 | * | 11/2004 | Watanabe et al. | 335/222 |
| 7,038,667 | B1 | * | 5/2006 | Vassallo et al. | 345/184 |
| 8,138,865 | B2 | * | 3/2012 | North et al. | 335/205 |
| 8,212,639 | B2 | * | 7/2012 | North et al. | 335/205 |
| 2008/0197004 | A1 | | 8/2008 | Ishigaki et al. | |
| 2010/0137779 | A1 | * | 6/2010 | Seitz | 604/20 |
| 2012/0161948 | A1 | * | 6/2012 | Kim | 340/407.1 |
| 2014/0125471 | A1 | * | 5/2014 | Organ et al. | 340/407.2 |

FOREIGN PATENT DOCUMENTS

DE 102010026910 A1 8/2011

* cited by examiner

*Primary Examiner* — Shawki S Ismail
*Assistant Examiner* — Lisa Homza
(74) *Attorney, Agent, or Firm* — Fox Rothschild LLP

(57) ABSTRACT

An electrical switch arrangement for controlling an electronic apparatus. The arrangement includes a reinforcement member, an electrical switch with tactile effect, a force transmission member which cooperates with the electrical switch with tactile effect, a permanent magnet which acts on a magnetic disc linked to the force transmission member to slow down the displacements of the force transmission member, and an electromagnet with controlled electrical power supply. When powered, the electromagnet produces a magnetic field which cancels the magnetic field of the permanent magnet.

10 Claims, 7 Drawing Sheets

ELECTRICAL SWITCH ARRANGEMENT AND DEVICE FOR CONTROLLING AN APPARATUS COMPRISING SUCH AN ARRANGEMENT

CROSS REFERENCE TO RELATED APPLICATION

This application claims the priority benefit of France Patent Application No. 1262312 filed Dec. 19, 2012, the content of which is hereby incorporated by reference in its entirety.

BACKGROUND

The present disclosure relates to an electrical switch arrangement for controlling an electrical or electronic apparatus. Additionally, the present disclosure relates to a device for controlling an electronic apparatus incorporating such a switch arrangement.

Various examples of design of a device for controlling an electronic apparatus are known that are of the type comprising a top panel, essentially planar and horizontal, on a top face of which a control member, such as the finger of a user or a stylus, can exert a control action consisting of an essentially downward-oriented pressure force, and comprising a supporting bottom reinforcement relative to which the top panel is mounted to move by an essentially downward vertical motion under the effect of the control action.

One such example of a device is, for example, described and represented in the France Patent document FR-B1-2.947.645, the content of which is hereby incorporated by reference in its entirety, in which the device includes an electrical switch, or a changeover switch, which is borne by the reinforcement and which can be actuated, under the effect of the control action, to produce a control signal for the electronic apparatus and, also, to produce a mechanical tactile sensation transmitted to the user.

The control top panel may include means for example for locating the position of the point of contact of the control action on the top face of the top panel. The top panel then constitutes a tactile "tablet", the device possibly also including means for displaying information, notably associated with the keying operations that the user performs on the top panel.

In such a design, the electrical switch, or changeover switch, makes it possible to detect any control action consisting in exerting, on the top face of the top panel, a pressure above a predetermined so-called threshold value. Such an electrical switch with tactile effect can change state when the value of the control action becomes greater than the threshold value and, upon this change of state, the switch enables the top panel to be displaced downwards to a so-called actuation position of the switch which also produces a tactile sensation which is perceived by the user. The user is thus informed tactilely that the validation/selection action has been exerted on the control device.

According to the design proposed in the document Germany Patent Document DE-A-10.2010.026.910, the content of which is hereby incorporated by reference in its entirety, it has already been proposed to arrange, in such a control device, controlled, or driven, locking mechanical means which block the actuation of the electrical switch with tactile effect and which, when they are electrically powered in response to a signal, unlock the actuation of this electrical switch with tactile effect.

These locking means consist of locking fingers belonging to electromagnets which, when the electromagnets are not powered, constitute fixed abutments which oppose the actuation travel of the force transmission member arranged vertically between the top panel and a push button, or the triggering member, of the electrical switch with tactile effect.

When, in response to a particular action of the user on the control panel, the locking electromagnets are powered, the latter release the abutment fingers and the user can then continue his or her vertical control action on the top panel to then provoke the change of state of the electrical switch with tactile effect which generates an electrical validation signal, and perceive in return the tactile sensation of this validation command.

Making use of mechanical locking means consisting of mechanical blocking abutments for which the unlocking is controlled by electromagnets is not satisfactory, notably for various reasons. For example, if a significant vertical force is applied by the user on the top panel, if unlocking does not occur, damage may occur to the locking means in their locked state.

Furthermore, the changes of state, between their locked position and their unlocked position, of the mechanical locking means are generators of unacceptable noises, notably through their amplification by the other components of the control device, and more particularly when such a control device is fitted for example in a motor vehicle passenger compartment.

Moreover, when the electrical switch with tactile effect has been actuated, after the controlled unlocking of the locking means, it is not possible to accurately determine the relative travels of the different components and it is not possible to determine whether, when the electrical power supply for the electromagnets is once again interrupted, the transmission member (whose control travel must be once again blocked) occupies a sufficiently high position to enable the locking or blocking state to be re-established.

The aim of the present disclosure is to provide a solution to these problems and to remedy the drawbacks which have just been mentioned.

SUMMARY OF THE INVENTION

This disclosure is not limited to the particular systems, methodologies or protocols described, as these may vary. The terminology used in this description is for the purpose of describing the particular versions or embodiments only, and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All publications mentioned in this document are incorporated by reference. All sizes recited in this document are by way of example only, and the invention is not limited to structures having the specific sizes or dimension recited below. As used herein, the term "comprising" means "including, but not limited to."

The present disclosure proposes an electrical switch arrangement for controlling an electrical or electronic apparatus, which includes a reinforcement member; an electrical switch with tactile effect which is borne by the reinforcement member and which can be actuated, under the effect of an actuation force applied in a direction of actuation, to produce a control signal for the apparatus; a force transmission member which is mounted to move relative to the reinforcement member, between a rest position and an actuation position of the electrical switch, and which comprises a proximal end which cooperates with the electrical switch and a distal end suitable for receiving the actuation force; a permanent magnet which acts, directly or indirectly, on the transmission member to slow down the displacements of the transmission member; and an electromagnet with a controlled electrical power supply and which, when powered, produces a magnetic field which cancels the magnetic field of the permanent magnet.

According to other features of the arrangement: it includes a link member which is linked in displacement with the transmission member and which is a magnetic part on which the permanent magnet acts when the electromagnet is not powered; the link member-forming magnetic part is a disc which is mounted to pivot relative to the reinforcement member, about a pivoting axis orthogonal to the direction of displacement of the transmission member, and the transmission member is linked in displacement to this disc by means of an axial finger that is offset relative to said pivoting axis; the direction of deplacement of the transmission member is parallel to the direction of actuation of the electrical switch; it includes a housing which houses, stacked axially without play from back to front and along the pivoting axis, several components of the arrangement, including at least the transmission member which is mounted to slide relative to the housing in its direction of displacement and the permanent magnet.

According to other features of the arrangement: the housing houses the link disc which is axially interposed without play between a front lateral face of the transmission member and a rear lateral face of the permanent magnet; the link disc is mounted to pivot relative to the housing; the housing houses the electromagnet, and the permanent magnet is axially interposed between the link disc and the electromagnet; the permanent magnet and the electromagnet form a unitary subassembly; the housing comprises axially-acting elastic means which stress the components stacked axially without play in the housing; and the housing houses the electrical switch, and the proximal end of the transmission member extends facing an actuation member of the electrical switch.

The present disclosure also proposes a device for controlling an electronic apparatus including an essentially planar and horizontal top panel on a top face of which a control member can exert a control action consisting of an essentially downward-oriented pressure force; a supporting bottom plate relative to which the top panel can move by an essentially downward vertical motion under the effect of the control action; and a switch arrangement according to the invention in which the reinforcement member is borne by said plate and in which the distal end of the transmission member cooperates with the top panel, in which the electrical switch can be actuated by the top panel under the effect of the control action to produce a control signal for the electronic apparatus.

BRIEF DESCRIPTION OF THE FIGURES

Other features and advantages of the invention will become apparent on reading the following detailed description, for an understanding of which reference will be made to the appended drawings in which.

DETAILED DESCRIPTION

Figure 1:
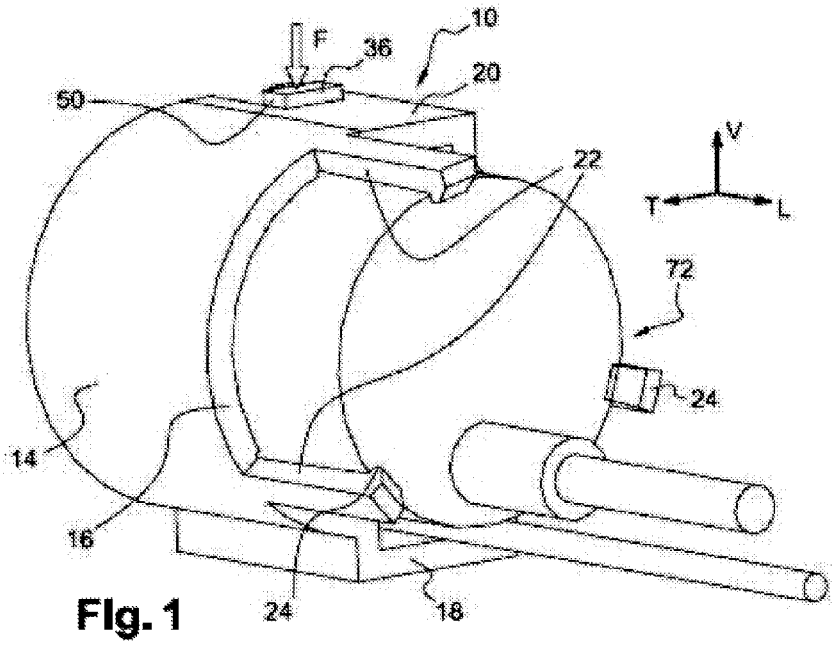
FIG. 1 illustrates a perspective view of an exemplary embodiment of a switch arrangement according to an embodiment.
Figure 2:
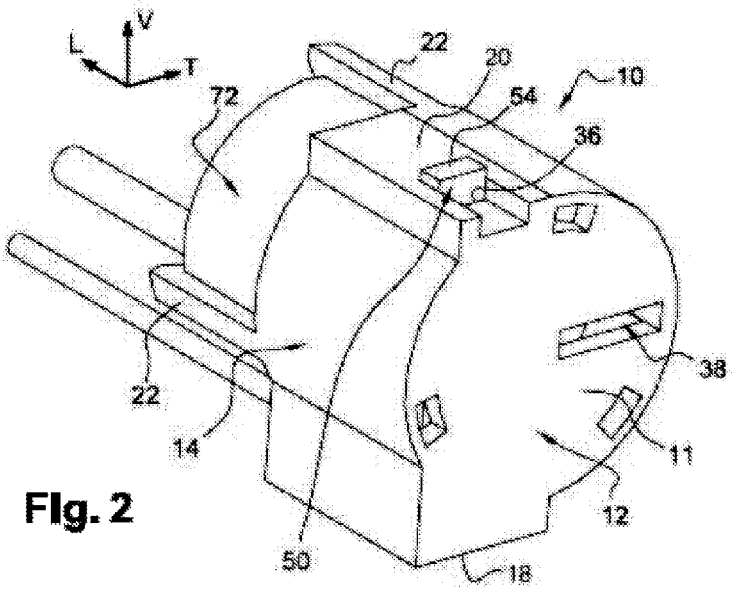
FIG. 2 illustrates a perspective view from another angle of the arrangement of FIG. 1.

In the following description, elements or components that are identical, analogous or similar will be designated by the same references. In a nonlimiting manner, to simplify the understanding of the description and of the claims, the terms horizontal, vertical, transversal, rear, front, etc. will be used notably with reference to the L, V, T trihedron illustrated in the figures and without reference to the Earth's gravity.

As can be seen notably in FIGS. 1 to 4, an electrical switch arrangement according to the invention has been represented, produced in the form of a unitary component 10 notably comprising a cylindrical housing 12 that is open axially towards the front on its main horizontal and longitudinal axis A.

The housing 12 is a plastic moulded part comprising a transversal end rear wall 11 and, also, a cylindrical lateral wall 14 delimited axially towards the front by a transversal edge 16. The lateral wall 14 includes a flat reinforcement-forming bottom portion 18 and a horizontal top panel 20.

From the front transversal edge 16, the housing 12 here includes three elastically-deformable axial arms 22, each of which is terminated by a hook 24 with an end ramp 26, the functions of which will be explained below. The inner transversal face 28 of the transversal wall includes three radial arms, forming reinforcing ribs, arranged in a star. The inner face 28 can also include a cylindrical central pivot 32 of axis A which extends by protruding axially towards the front.

Figure 7:
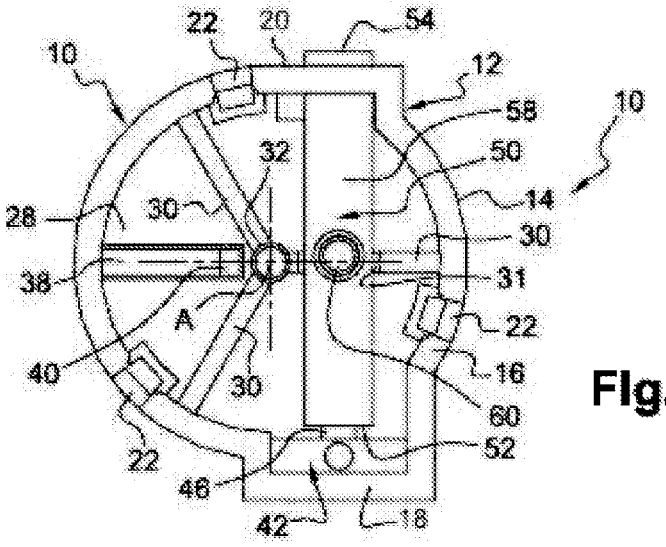
FIG. 7 illustrates a view similar to that of FIG. 6, without the link magnetic disc according to an embodiment.
Figure 8:
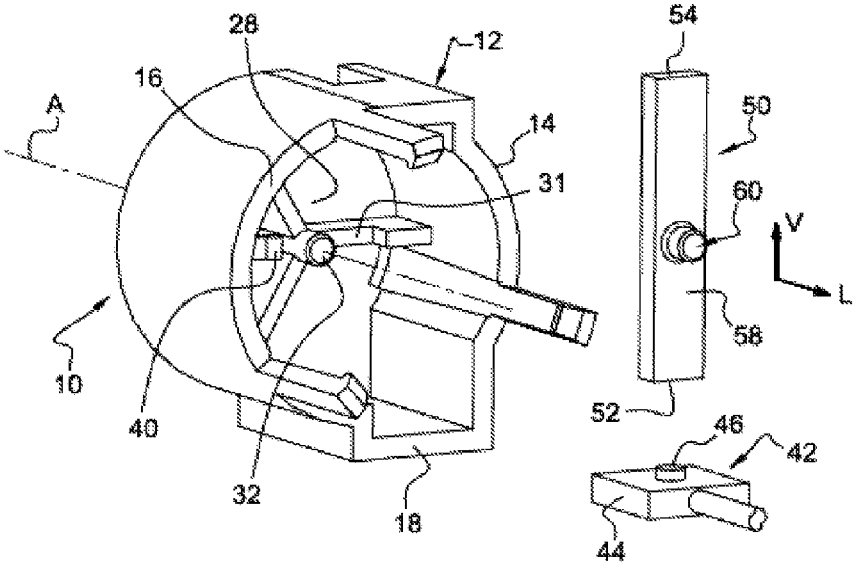
FIG. 8 illustrates a larger scale exploded perspective view which illustrates the housing, the switch with tactile effect and the transmission member according to an embodiment.
Figure 9:
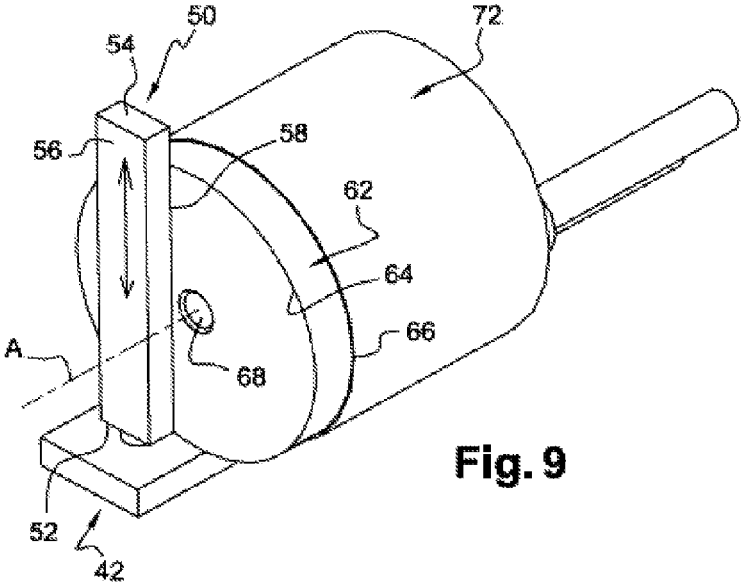
FIG. 9 illustrates a rear perspective view which illustrates the electrical switch with tactile effect, the force transmission member, the link magnetic disc and the permanent magnet-electromagnet assembly according to an embodiment.
Figure 10:
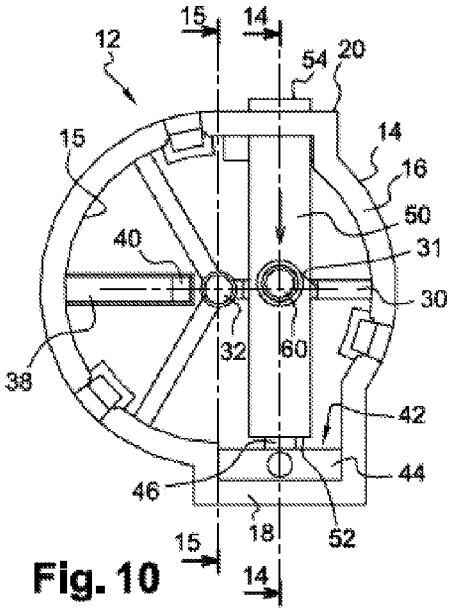
FIG. 10 illustrates a view identical to that of FIG. 6 in which the force transmission member is represented in its high rest position according to an embodiment.
Figure 11:
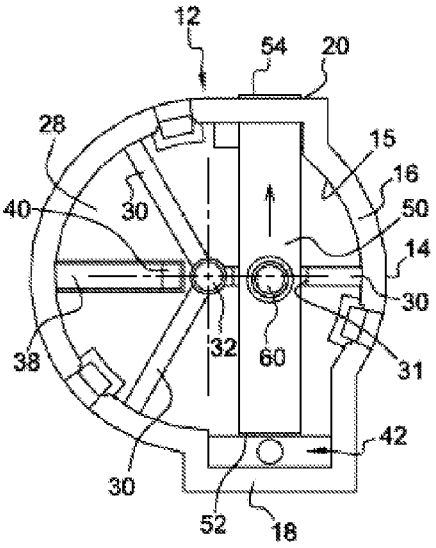
FIG. 11 illustrates a view similar to that of FIG. 10 in which the transmission member is represented in its low actuation position of the electrical switch with tactile effect according to an embodiment.

The horizontal arm 30 on the left, referring to FIG. 7, includes a notch 31 which is vertically aligned with a vertically-emerging opening 36, of rectangular contour, formed in the horizontal top panel 20. The bottom transversal wall includes, horizontally on the left and between two radial arms 30 with reference to FIG. 7, a spring-forming elastic tab 38, the free end 40 of which is rounded and protrudes axially towards the front inside the housing 12. By its concave face 15, the lateral wall 14 of the housing 12 delimits an inner cylindrical housing which is open axially towards the front.

In the terms of the invention, the reinforcement-forming bottom portion 18 constitutes a reinforcement member which bears an electrical switch with tactile effect 42, of known general design, of which the plinth or base, 44, is fixed in the housing 12 on the reinforcement-forming bottom portion 18.

As is known, the electrical switch with tactile effect 42 can include a top push button 46 for its actuation, from top to bottom, in the vertical direction V. When in position mounted in the housing, the push button 46 of the switch 42 is aligned vertically with the notch 31 and with the opening 36.

To apply an actuation force F (see FIG. 1) to the push button 46 of the switch 42, a force transmission member 50 is provided which is here a vertical rod of rectangular section which is mounted to slide in the housing 12, in a vertical direction of displacement which is orthogonal to the horizontal axis A.

The displacements of the transmission member 50 relative to the housing 12 are guided notably by the opening 36. The transmission member 50 includes a bottom proximal end 52 which cooperates with the switch 42 by bearing against the top end of the push button 46 and it includes a top distal end 54 suitable for receiving an actuation force F.

In the assembled position of the different components, the force transmission member 50 bears, by its transversal and rear vertical face 56, axially towards the rear against the corresponding rear bottom edges of the notch 31 and of the opening 36. On its front vertical face 58, the force transmission member 50 includes a link axial finger 60 which extends axially towards the front 60.

Figure 3:
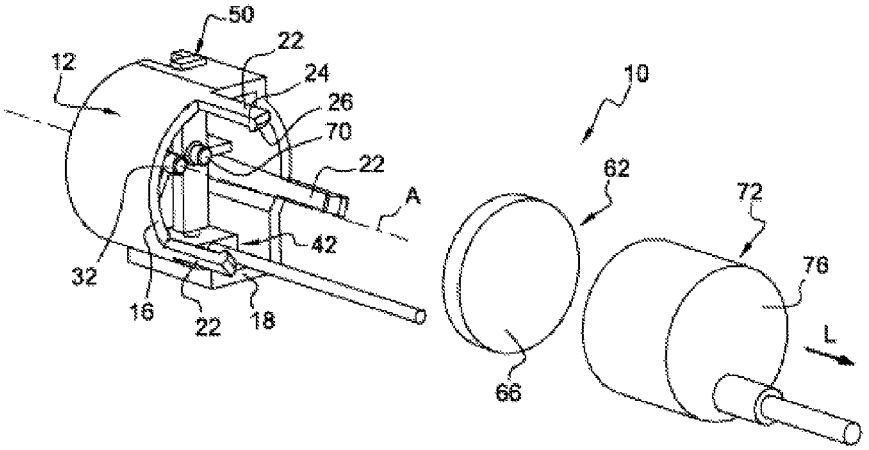
FIGS. 3 and 4 illustrate views similar to those of FIGS. 1 and 2, showing an exploded representation of the link magnetic disc and the permanent magnet-electromagnet assembly according to an embodiment.
Figure 4:
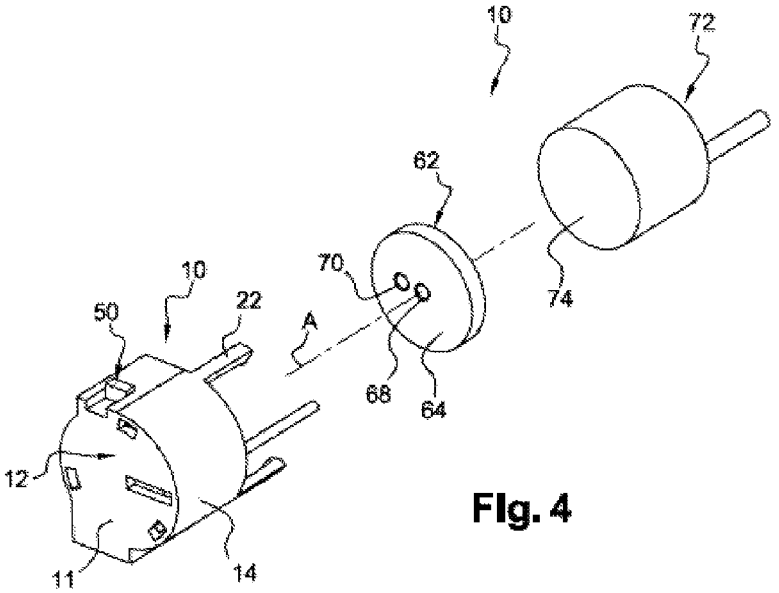
Figure 5:
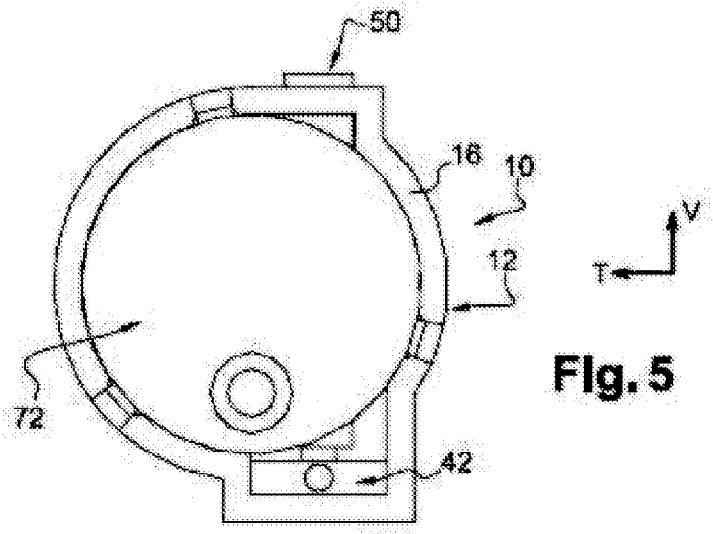
FIG. 5 illustrates an endwise axial view from the front of the arrangement of FIGS. 1 and 2.
Figure 6:
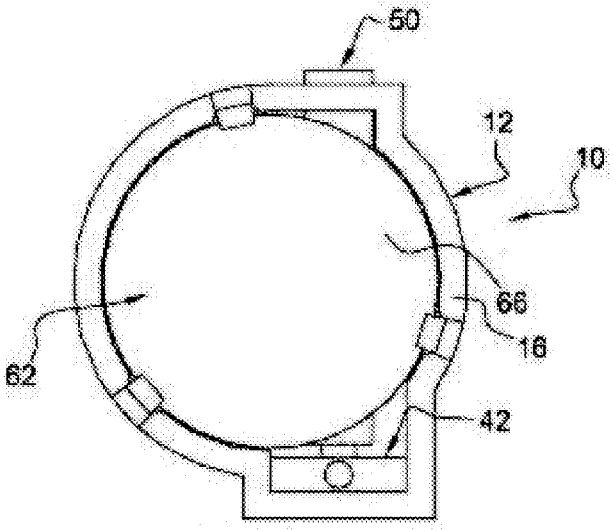
FIG. 6 illustrates a view similar to that of FIG. 5 without the permanent magnet-electromagnet assembly according to an embodiment.
Figure 14:
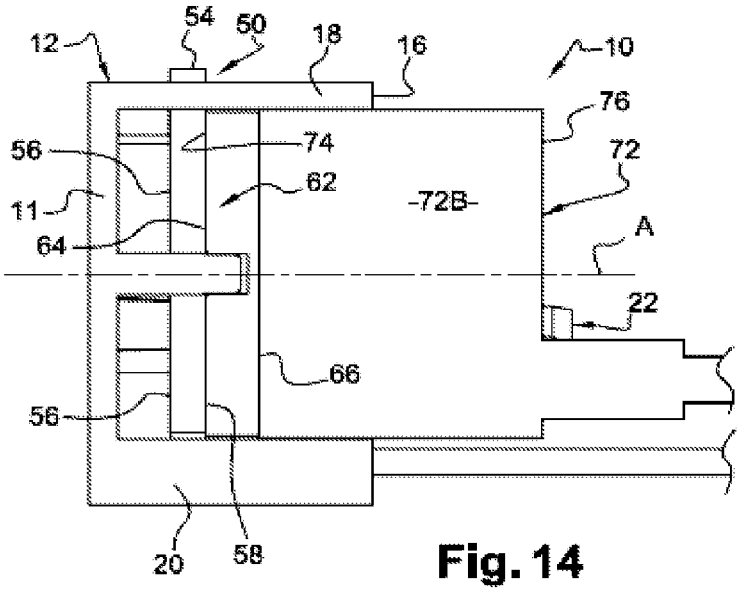
FIG. 14 illustrates a cross-sectional view through a vertical axial plane along the line 14-14 of FIG. 10.
Figure 15:
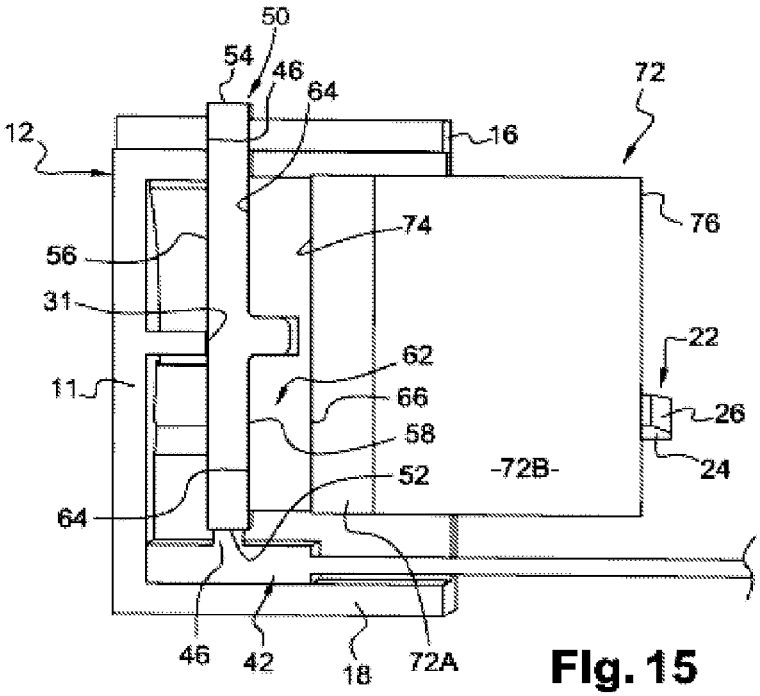
FIG. 15 illustrates a cross-sectional view through a vertical axial plane along the line 15-15 of FIG. 10.

In the assembled position, and as can be seen notably in FIGS. 3, 14 and 15, the free front end sections of the central pivot 32 and of the link axial finger 60 are situated axially substantially in the same plane.

The housing 12 also houses a disc 62 delimited by a rear transversal face 64 and by a front transversal face 66. The disc 62 is a part made of a magnetic material, that is to say susceptible to magnetic attraction by a magnetic field which, within the meaning of the invention, constitutes a magnetic link part or member which is linked in displacement, one-to-one, with the force transmission member 50.

The disc 62 includes a rear central hole 68 in which the pivot 32 is received so as to constitute means for mounting the disc 62 to pivot relative to the housing 12, in both directions, about the axis A. The rear face 64 can also include a linking axial cylindrical hole 70 which receives the link axial finger 60 of the force transmission member 50.

In the mounted position, the rear face 64 of the magnetic disc 62 is pressed axially without play against the front vertical transversal face 58 of the force transmission member 50. The link in displacement of the force transmission member 50 and of the disc 62 may be such that the angular pivoting in either direction of the disc 62 about the axis A corresponds to an upwards or downwards vertical displacement of the force transmission member 50.

Figure 12:
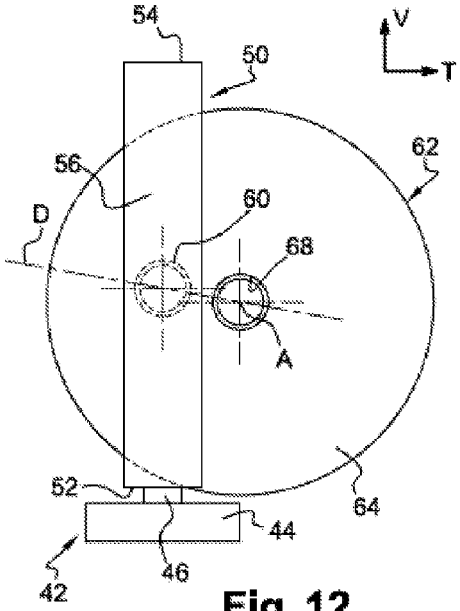
FIGS. 12 and 13 illustrate two schematic views which illustrate the relative positions of the electrical switch, of the force transmission member and of the link magnetic disc in the two positions illustrated in FIGS. 10 and 11.

FIG. 12 schematically shows the relative position of the different components when the assembly is at rest, that is to say when the force transmission member 50 is in its high rest position with its bottom proximal end 52 bearing on the actuation push button 46 of the electrical switch with tactile effect 42.

Figure 13:
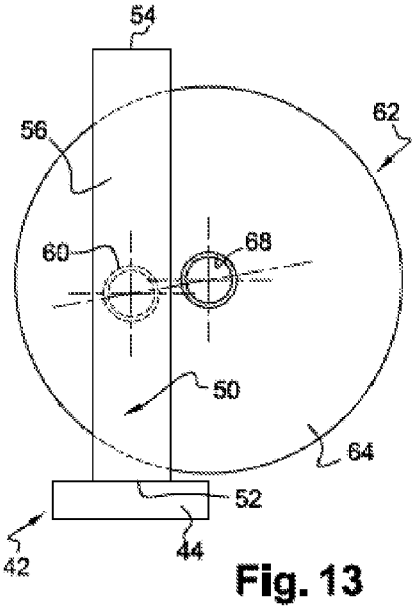

Similarly, the same components have been represented in FIG. 13 in the active low position of the force transmission member 50. Because of the radial offset of the link axial finger 60 relative to the axis A of the pivot 32 and of the rear central hole 68, any vertical displacement of the force transmission member 50 corresponds to a pivoting angular displacement of the disc 62 about the axis A. This maximum angular travel of the disc 62 about the axis A is represented and can be seen in FIGS. 12 and 13 by the angular displacement of the straight line D passing through the axis of the link axial finger 60 and of the axial cylindrical hole 70 and, also, through the axis A.

So as to slow down the vertical displacements of the force transmission member 50, notably to oppose its vertically downwards actuation travel, controlled magnetic means are provided for angularly retaining the link magnetic disc 62 in a determined angular position. Here, these controlled means consist of the subassembly 72 which incorporates, on the one hand, at its rear axial end, a permanent magnet 72A and, at its front axial end, a controlled electromagnet 72B. These two components 72A, 72B associated and integrated in the subassembly 72 constitute a so-called current-breaking "magnetic sucker", for example of the type marketed under the brand name "Lux'On" (registered trademark) by the company LUXALP.

Such a subassembly 72 can require no electrical power supply and therefore also involves no electrical consumption, when in use, as long as the winding of the rear electromagnet is not powered. In this passive state of the winding of the electromagnet 72B not powered by current, the rear permanent magnet 72A exerts a permanent field on the disc made of magnetic material 62.

When the winding of the rear electromagnet is powered, the latter produces a magnetic field which cancels the effects of the magnetic field of the permanent magnet and which therefore "releases" the disc made of magnetic material 62 and frees it to rotate. Advantageously, the rear section of the subassembly 72 is housed in the housing 12 and its rear end transversal face 74 bears axially without play pressed against the front transversal face 66 of the disc made of magnetic material 62.

All of the components, and notably the magnetic disc 62 and the electromagnetic sucker-forming subassembly 72 are held pressed axially in the housing by the arms 22 with their hooks 24 which bear against the front end transversal face 76 of the subassembly 72.

In order to ensure that there is no axial play between these components, the elastic tab 38, with its rounded end 40, ensures a forward axial thrust against the components, serving to take up play.

Figure 16:
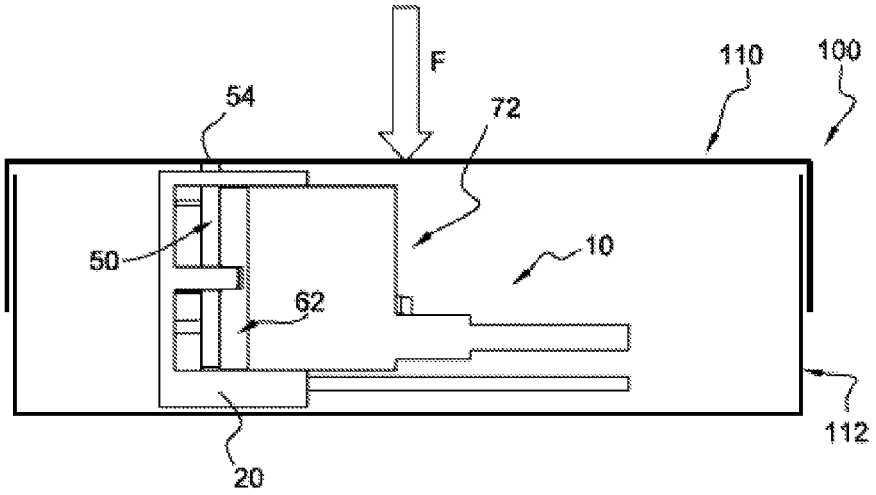
FIG. 16 illustrates a schematic view illustrating the integration of a switch arrangement according to the invention in a control device according to an embodiment.

FIG. 16 schematically represents a control device 100, of the type of that described in the preamble of the present description, essentially consisting of a moving top panel 110 which can be displaced vertically relative to a bottom plate 112.

According to the teachings of the present disclosure, an electrical switch arrangement 10 according to the invention is housed inside the device 100 and is interposed vertically between the plate 112 and the top panel 110. Thus, the force transmission member 50 is interposed vertically between the inner face of the top panel 110 and the bottom plate 112.

When the conditions of use of the top panel 110 by the user, after analysis of the signals generated by the position of the user's control action on the panel 110, determine an "authorization" to be able to exert a validation/selection control force, the electromagnet 72B of the subassembly 72 is controlled so as to be powered by electricity to release the link disc 62 in order to allow the downward vertical displacement of the force transmission member 50 to actuate the electrical switch with tactile effect.

By virtue of the design according to the invention in which the means 62 and 72 provide a function for magnetically slowing down the displacement of the force transmission member 50, all of the displacements and implementation of the different components of the arrangement 10 are performed continuously, without play, and without spurious noise.

The invention is not limited to the embodiment which has just been described. As a variant which is not represented, the force transmission member may be made of a magnetic material, the permanent magnet then cooperating directly with this member to slow it down. Similarly, the direction of displacement of the transmission member 50 is not necessarily parallel to the direction of actuation of the switch 42. The electrical switch with tactile effect 42 does not necessarily include an actuation push button, the proximal end 54 being able to cooperate directly with the bistable triggering member ensuring the electrical switch and tactile effect generating function.

It will be appreciated that various of the above-disclosed and other features and functions, or alternatives thereof, may be desirably combined into many other different systems or applications or combinations of systems and applications. Also that various presently unforeseen or unanticipated alternatives, modifications, variations or improvements therein may be subsequently made by those skilled in the art which are also intended to be encompassed by the following claims.

The invention claimed is:

1. An electrical switch arrangement for controlling an electronic apparatus comprising:

a reinforcement member;

an electrical switch with tactile effect which is borne by the reinforcement member and which when actuated, under the effect of a downwardly-oriented actuation force will produce a control signal for the apparatus;

a force transmission member which is mounted to move relative to the reinforcement member between a rest position and an actuation position of the electrical switch with tactile effect, and which comprises a proximal end which cooperates with the electrical switch with tactile effect and a distal end suitable for receiving the actuation force;

a permanent magnet which acts on the force transmission member to slow down the displacements of the force transmission member;

an electromagnet with a controlled electrical power supply which, when powered, produces a magnetic field that cancels the magnetic field of the permanent magnet; and a link member, on which the permanent magnet acts when the electromagnet is not powered, is linked to the force transmission member;

wherein the link member, which comprises a disk, is mounted to pivot in relation to the reinforcement member about a pivoting axis orthogonal to the direction of displacement of the force transmission member; and wherein the force transmission member is linked to the disk by means of an axial finger, wherein the axial finger is offset relative to the pivoting axis.

2. The electrical switch arrangement according to claim 1, wherein the direction of displacement of the force transmission member is parallel to the direction of actuation of the electrical switch with tactile effect.

3. The electrical switch arrangement according to claim 2, further comprising a housing which houses, stacked axially without play from back to front and along said pivoting axis, at least:

the force transmission member which is mounted to slide relative to the housing in said direction of displacement; and the permanent magnet.

4. The electrical switch arrangement according to claim 3, wherein the housing houses the link disc which is axially interposed without play between a front vertical face of the force transmission member and a rear end traversal face of the permanent magnet.

5. The electrical switch arrangement according to claim 4, wherein the link disc is mounted to pivot relative to the housing.

6. The electrical switch arrangement according to claim 5, wherein the housing houses the electromagnet, and in that the permanent magnet is axially interposed between the link disc and the electromagnet.

7. The electrical switch arrangement according to claim 6, wherein the permanent magnet and the electromagnet form a unitary subassembly.

8. The electrical switch arrangement according to claim 3, wherein the housing comprises axially-acting elastic means which stress said components stacked axially without play in the housing.

9. The electrical switch arrangement according to claim 3, wherein the housing houses the electrical switch with tactile effect, and the proximal end of the force transmission member extends facing an actuation member of the electrical switch with tactile effect.

10. A device for controlling an electronic apparatus comprising:

a reinforcement member;

an essentially planar and horizontal top panel on a top face on which a control action comprising a downward-oriented force, when exerted, will cause an actuation force to be exerted on a force transmission member;

an electrical switch with tactile effect which is borne by the reinforcement member and which, when actuated under the effect of the control action, will produce a control signal for the apparatus;

wherein the force transmission member is mounted to move relative to the reinforcement member between a rest position and an actuation position of the electrical switch, and comprises a proximal end which cooperates with the electrical switch with tactile effect and a distal end suitable for receiving the actuation force;

wherein the apparatus also comprises:

a permanent magnet which is configured to cause the force transmission member to slow down the movement of the force transmission member between the rest position and the actuation position;

an electromagnet with a controlled electrical power supply which, when powered, will produce a magnetic field which cancels the magnetic field of the permanent magnet; and a link member, on which the permanent magnet will act when the electromagnet is not powered, that is linked with the force transmission member and which comprises a disk that is mounted to pivot in relation to the reinforcement member about a pivoting axis orthogonal to the direction of displacement of the force transmission member; and wherein the force transmission member is linked to the disk by means of an axial finger, wherein the axial finger is offset relative to the pivoting axis.

* * * * *